US006938602B2

(12) United States Patent
Hora et al.

(10) Patent No.: US 6,938,602 B2
(45) Date of Patent: Sep. 6, 2005

(54) MULTI-PIECE VALVE FOR RECIPROCATING PISTON ENGINES

(75) Inventors: Paval Hora, deceased, late of Kornwestheim (DE); by Zdenka Hora, legal representative, Kornwestheim (DE); by Thomas Marko Hora, legal representative, Kornwestheim (DE); Jens Meintschel, Esslingen (DE); Martin Schlegl, Rudersberg (DE); Thomas Stolk, Kirchheim (DE); Karl-Heinz Thiemann, Korb (DE); Alexander Gaisberg-Helfenberg, Beilstein (DE)

(73) Assignee: DaimlerChrysler AG, Stuttgart (DE)

( * ) Notice: Subject to any disclaimer, the term of this patent is extended or adjusted under 35 U.S.C. 154(b) by 0 days.

(21) Appl. No.: 10/498,064

(22) PCT Filed: Oct. 31, 2002

(86) PCT No.: PCT/EP02/12143

§ 371 (c)(1),
(2), (4) Date: Nov. 22, 2004

(87) PCT Pub. No.: WO03/050395

PCT Pub. Date: Jun. 19, 2003

(65) Prior Publication Data

US 2005/0076875 A1 Apr. 14, 2005

(30) Foreign Application Priority Data

Dec. 12, 2001 (DE) ..... 101 60 942

(51) Int. Cl.[7] ..... F02N 3/00

(52) U.S. Cl. ..... 123/188.3

(58) Field of Search ..... 123/188.3

(56) References Cited

U.S. PATENT DOCUMENTS

| | | | |
|---|---|---|---|
| 2,136,690 | A | 11/1938 | Jardine |
| 4,359,022 | A | 11/1982 | Nakamura et al. |

FOREIGN PATENT DOCUMENTS

| | | | |
|---|---|---|---|
| DE | 100 29 299 | A1 | 1/2002 |
| DE | 100 38 332 | A1 | 2/2002 |
| EP | 0 296 619 | A1 | 12/1988 |
| WO | WO 94/19143 | | 9/1994 |

*Primary Examiner*—Noah P. Kamen
(74) *Attorney, Agent, or Firm*—Crowell & Moring LLP

(57) ABSTRACT

The invention relates to a multi-piece valve for reciprocating piston engines in which the valve stem is connected to the valve head in a manner resistant to both tension and compression. In the area of a center through-opening the valve head has an annular bearing surface for a stem-side flange. In addition, the center opening widens on the combustion chamber-side of the valve head, the head-side end of the valve stem being plastically expanded so that it fills this enlargement, forming a positive interlock. In order to improve the service life of the connection between valve head and valve stem, according to the invention the combustion chamber-side enlargement of the center opening and accordingly also the conformed, end-side expansion of the valve stem are of non-circular design so that a positively interlocking torsionally fixed connection is produced between the valve stem and the valve head.

12 Claims, 3 Drawing Sheets

MULTI-PIECE VALVE FOR RECIPROCATING PISTON ENGINES

BACKGROUND OF THE INVENTION

The invention relates to a multi-piece valve for reciprocating piston engines.

Among other things, U.S. Pat. No. 2,136,690 discloses a multi-piece solid-stem valve, in which the valve seat has a reinforced lining of a wear-resistant material. The reinforced lining comprises a prefabricated, centrally perforated disk composed of a resistant and thermally conductive composite material which is conically beveled at the outer edge, said reinforced lining disk extending to the edge of the valve head and forming the head-side sealing face. The composite material is formed from a matrix composed of tough, conductive metal, preferably containing copper, into which finely dispersed particles of a hard, resistant material such as tungsten are firmly embedded. These hard particles are intended not only to protect the matrix but also to prevent or at least delay destruction of the valve sealing faces. In the known valve the disk serving as reinforced lining is riveted on to the head-side end of the valve stem together with a backing disk of conventional valve material applied to the combustion chamber side, the stem material serving as rivet. Here therefore, the valve head itself is of multi-piece construction, comprising two disks. A relatively wide shoulder is forged on the valve stem in order to axially support the valve head, comprising reinforced lining disk and backing disk, and prevent it from tilting. With a pin serving as rivet shank, the head-side end of the valve stem projects through the center opening of the two disks, the outer end of this pin being deformed into a rivet head extending in a spot-facing of the backing disk opening. Although the valve head is connected to the valve stem by a positively interlocking connection acting in both directions of the axial force—tensile and compressive—a disadvantage of the known valve is that in order to guide the disk connection of the multi-piece valve head and prevent it from tilting, a relative wide radial shoulder has to be formed on to the valve stem, the radial width of which shoulder in the example of an embodiment represented by the prior art is equal to approximately one third of the stem diameter. The shoulder formed by upsetting assumes not only the function of an axial support designed to prevent tilting of the multi-layered valve head, but also, by virtue of the smooth transition from the stem cross-section to the shoulder circumference, the function of a flow baffle element on the upper side of the valve head around which the flow passes. Another disadvantage is that the high-frequency impact stresses can result in minute relative displacements between the connected parts in the direction of rotation, which can lead to wear at the contact faces and hence to a loosening of the connection.

The earlier patent application by the present applicant, DE 100 29 299 A1, not previously published, not only describes different design constructions for multi-piece valves of the type addressed here but also goes into the methods of manufacturing the types of valve presented. However, for production reasons all of the valves disclosed are provided with a hollow stem, which although advantageous in the case of the present invention is in no way an essential prerequisite. Advantages of the known valve are the low weight and/or the long service life of the valve, which ensue from the fact that lightweight materials, in particular ceramic and titanium aluminide, capable of withstanding high thermal and/or tribological stresses can be used for the valve head. One disadvantage of the known valve, however, is that possible differences in the coefficients of thermal expansion, which depending on the mating of materials can sometimes be considerable, can result at the operating temperature of the multi-piece valve in a relaxation of the pre-tensioning in the connection between valve stem and valve head. Under the stresses occurring in operation this could likewise lead to a relative shifting of the contact surfaces and consequently to contact wear and loosening of the connection.

For the sake of completeness, reference should also be made to EP 296 619 A1, which likewise shows a multi-piece valve, the structural components of which are composed of different materials. The tubular valve stem is preferably composed of chromium molybdenum steel. The valve head, which should preferably be composed of a titanium aluminide intermetallic material, can be produced by precision casting. The finished valve head is provided on the upper side with a blind hole to receive the head-side stem end. The valve stem can be fixed in the blind hole by shrink fitting, cold pressing, brazing or by a combination of these joining techniques. In one case shown in the drawing of this specification, the inner surface of the blind hole is moreover formed with an axial corrugation, the end wall of the stem tube being expanded under the effect of pressure and localized heating and at the same time being designed to positively interlock in the corrugations on the hole side. In the case of the multi-piece hollow-stem valve according to EP 296 619 A1, however, there is reason to doubt whether the connection between valve stem and valve head will be sufficiently durable under the considerable static and dynamic loads imposed by both the thermal and the mechanical stresses.

SUMMARY OF THE INVENTION

The object of the invention is to improve upon the above-described valves so as to improve the service life of the connection between valve head and valve stem.

According to the invention this object is achieved in a valve that includes a valve stem and a valve head. The valve stem includes a head-side end and a flange. The valve head includes a combustion chamber-side, a center through-opening extending to the combustion chamber-side, and an annular bearing surface. The center through-opening has a larger section at the combustion chamber-side. The valve stem extends into the center through-opening of the valve head. The flange of the valve stem bears against the annular bearing surface of the valve head to limit the insertion depth of the valve stem into the center through-opening of the valve head. The head-side end of the valve stem is expanded in the larger section of the center through-opening. The larger section of the center through-opening and the expanded head-side end of the valve stem deviate from a rotationally symmetrical shape to form a positive torsional interlock connection between the valve stem and the valve head.

The torsionally fixed design of the connection between valve head and valve stem effectively prevents any relative movement of the connected parts. Creep movements and resulting wear in the joint are therefore avoided. The joint is thereby better able to withstand the thermal and mechanical stresses constantly occurring in engine operation.

Other objects, advantages and novel features of the present invention will become apparent from the following detailed description of the invention when considered in conjunction with the accompanying drawings.

DETAILED DESCRIPTION OF THE DRAWINGS

Figure 1:
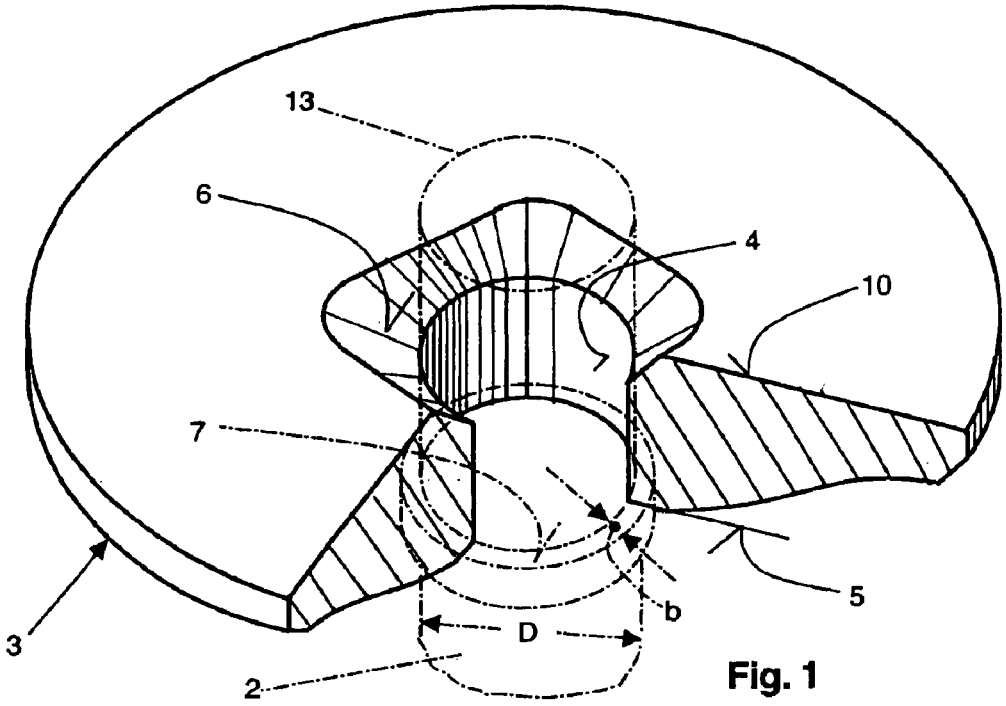
FIG. 1 shows a perspective detailed representation of a valve head looking towards the combustion chamber side and the non-circular enlargement of the center opening.

The invention, which for the moment will be explained below in general terms in connection with the various embodiments, proceeds from a multi-piece valve 1, 1', 1" for reciprocating piston engines. The valve includes a valve stem 2, 2', 2" and a structurally separate valve head 3, 3', 3", 3'", which is connected to the valve stem 2 by a positively interlocking connection acting in both the tensile and compressive directions. For this purpose the single-piece valve head 3, 3', 3", 3'" is provided with a center through-opening 4, 4' to receive the head-side end of the valve stem, the edge of which opening situated on the combustion chamber side 10 of the valve head 3 is conically enlarged, thus forming an enlargement 6, 6', 6". For its part the valve stem 2 on the outer circumference has a flange 7, 7' perpendicular to the axis and defining the insertion depth of the valve stem into the center opening, and an annular bearing surface 5, 5' is being provided in the area of the center opening 4 of the valve head 3 for the stem-side flange 7 to bear against. After fitting the head and stem together, the combustion chamber-side or head-side end 13, 13' of the valve stem is plastically expanded in the area of the combustion chamber-side enlargement 6 of the center opening, filling the center opening and forming a positive interlock, so that a heading 8, 8' is produced. The heading 8, 8', together with the pair of bearing surfaces, forms a positively interlocking connection between the head and the stem in the tensile direction and in the compressive direction. Considering that the valve head is domed on its upper side so as to assist the flow and therefore has a certain overall height, so that it can function as a flow baffle element, the pair of axial bearing surfaces 5 and 7 only needs to be narrow in a radial direction. Tilt-free guidance of the valve head in relation to the valve stem is achieved through the overall height of the valve head and the correspondingly large insertion depth of the stem in the valve head.

In order to be able to improve the service life of the connection between the valve head and the valve stem, according to the invention the combustion chamber-side enlargement 6, 6', 6", 6 of the center opening 4, 4' and accordingly also the conformed, end-side expansion 8, 8' of the valve stem 2, 2', 2" are designed to deviate from a rotationally symmetrical shape in such a way that a positively interlocking, torsionally fixed connection is formed between the valve stem 2, 2' and 2" and the single-piece valve head 3, 3', 3", 3'".

The torsional fixing between the valve head and the valve stem effectively prevents any relative movement of the connected parts during engine operation, and wear in the joint due to creep movements is therefore avoided. The joint is thereby better able to withstand the thermal and mechanical stresses constantly occurring in engine operation. The torsional fixing can be produced at no additional manufacturing cost.

Figure 2:
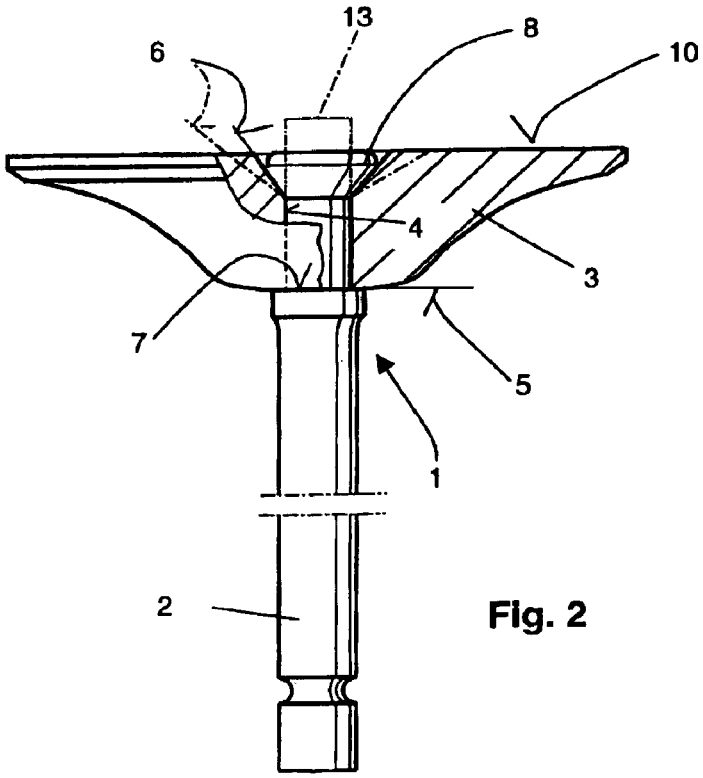
FIG. 2 shows a valve assembled using a valve head according to FIG. 1.

In the example of an embodiment shown in FIGS. 1 and 2 the combustion chamber-side enlargement 6 of the center opening 4 is conical in the manner of a truncated pyramid with rounded edges between the flat sides. The valve head 3'" according to FIG. 5 would suppose an enlargement identical in shape to that shown in FIG. 1, although the valve head 3 according to FIG. 5 in other features differs from the valve head 3 according to FIGS. 1 and 2, which will be explored in further detail below.

Figure 3:
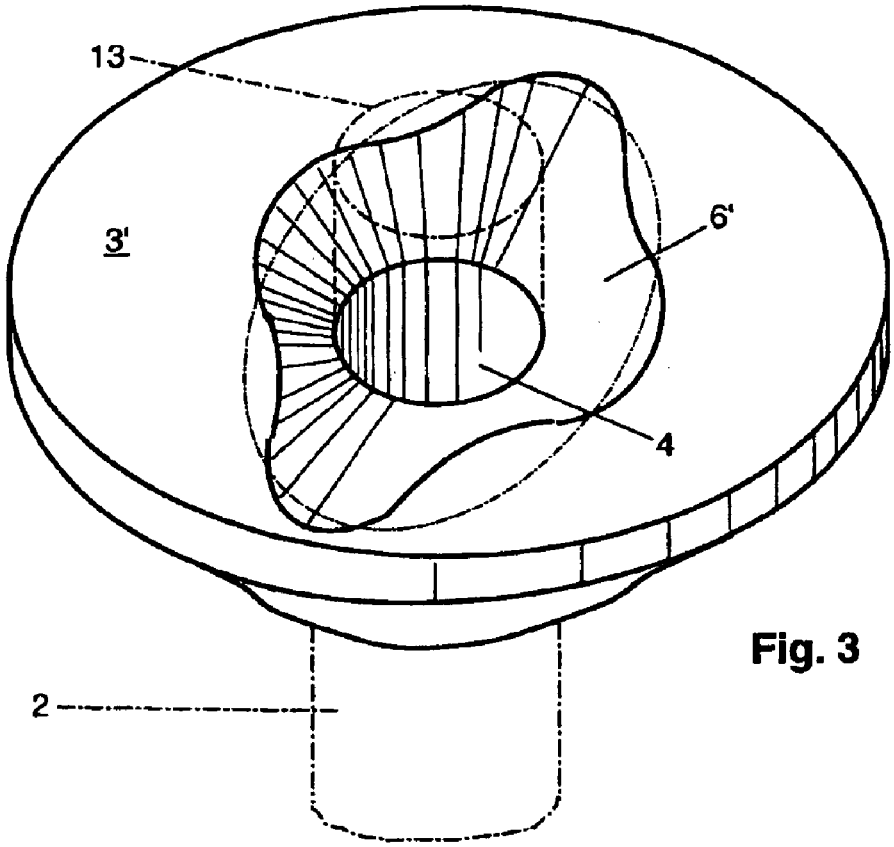
FIGS. 3 and 4 show two further examples of embodiments of valve heads and non-circular enlargements of the center opening.
Figure 4:
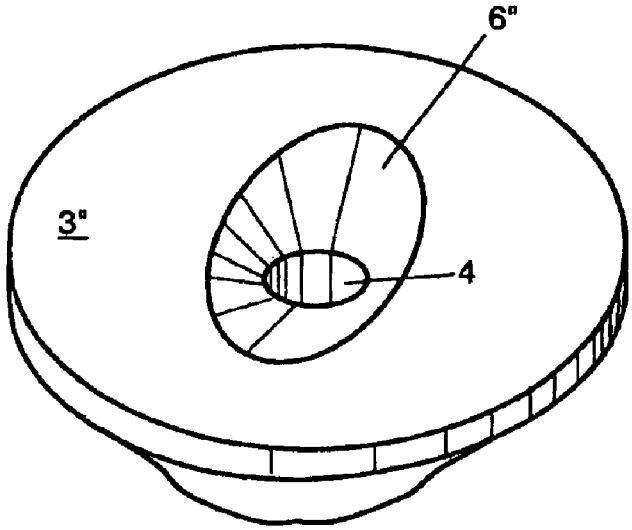

In the valve head 3' according to FIG. 3 the combustion chamber-side enlargement 6' is also substantially conical in design, and a cone of pronounced oval shape is superimposed on a circular cone coaxial with the center opening. The two overlapping types of cone merge into one another, and are strongly rounded in the area of the mutual overlaps. The valve head 3" shown in FIG. 4 only has one conical enlargement 6" of pronounced oval shape.

All three embodiments of enlargements 6, 6', 6" shown are of a pronounced non-circular shape, but by virtue of the gentle transitions and/or deviations from a rotational shape can be completely filled, true to shape, by a heading 8, 8' plastically formed into the enlargement. Both characteristics are important for an effective positive interlock preventing relative torsion. The smooth transitions and/or deviations from a rotational shape are also advantageous in producing such enlargements 6, 6', 6", whether these are produced by a forming tool—forging, casting, sintering—or by a chip-forming non-circular turning process. Manufacturing the non-circular enlargements 6 does not require any additional cost compared to the manufacture of rotationally symmetrical spot-facings, especially where the enlargements are produced by a forming tool which forms the valve head.

The embodiment of a valve 1 shown in FIGS. 1 and 2 has a solid valve stem 1, in which the stem-side flange 7 is machined out, for example, by a chip-forming turning process. The flange 7 is radially relatively narrow and only needs to absorb the axial pre-stressing of the connection. The radial width b of the stem-side flange 7 and the head-side bearing surface 5 is no more than about 25%, preferably approximately 15 to 20% of the stem diameter D. The valve head 3 is reliably prevented from tilting in relation to the stem 2 by the relatively large overall height of the head and the correspondingly large insertion depth of the stem. The insertion depth is significantly greater than the diameter of the stem in this area.

From the point of view of weight, even a solid valve stem, that is to say one with a solid cross-section, is still perfectly feasible in a multi-piece valve where a lightweight material is used for the valve head. The weight saving compared to a conventional valve then lies exclusively in the reduced weight of the valve head. In this context the following materials should be mentioned as feasible lightweight materials for the valve head:

a ceramic, in particular silicon carbide (SiC),
an intermetallic phase, in particular titanium aluminide,
a titanium-aluminum alloy.

In addition to the weight advantage, these materials also possess outstanding thermal and mechanical characteristics, which make them particularly desirable as valve material. Widespread use of these materials, however, has hitherto always foundered on the justifiable costs of processing and/or the question of a reliable and durable joining technique between the valve stem and the valve head.

Figure 5:
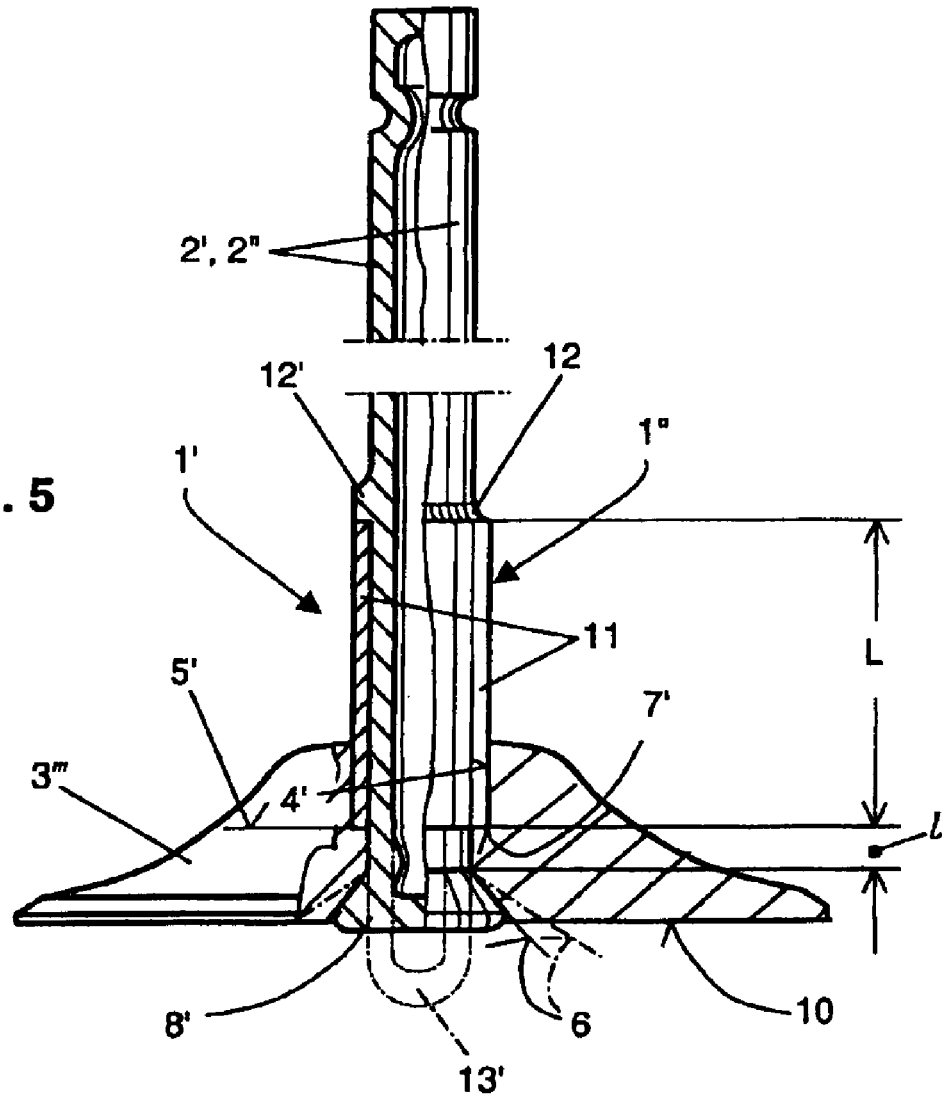
FIG. 5 shows two different variants of a further example of an embodiment of a multi-piece valve with hollow stem and separate tensile expansion section in the connection between valve head and valve stem.

In order to further reduce the weight of the valve, the stem made from a valve steel may be of hollow design, as is shown by the example of the valve 1' and 1" according to FIG. 5. The end-side walls of the hollow stem are sealed gas-tight, which can be very efficiently achieved by a continuous rolling process. Such a hollow stem may also be partially filled with a coolant, such as sodium, so that the operating temperature level of the valve can be reduced. After insertion of the head-side, as yet unheaded stem end 13 into the center opening 4' until the annular bearing surfaces 5' and 7' are in contact with one another, the projecting end of the valve stem is upset into the non-circular enlargement 6, so that a countersunk head-shaped heading 8' is produced. This heading process can be performed in the hot state, for example also by the aforementioned continuous rolling process. At the same time the combustion chamber-side enlargement 6 of the center opening 4' is also filled by the upset head 8' forming a positive interlock, so that an effective torsional fixing is produced between the valve head 3 and the valve stem 2' or 2".

Some of the possible lightweight materials, in particular ceramics, differ quite distinctly from steel in their thermal expansion properties, that is to say they expand substantially less than steel in the event of a temperature increase. In order to nevertheless prevent the connected parts in such a mating of materials coming loose under the effects of heat, in the embodiment represented in FIG. 5 the flange 7', fitted to the outside of the valve stem 2', 2" perpendicular to the axis and defining the insertion depth, is formed by a tight-fitting push-on, tubular sleeve 11 of a specific length L. The tubular sleeve is immovably fixed by its end remote from the head in a predefined axial position on the valve stem 2', 2". In the variant shown on the left in FIG. 5 the tubular sleeve rests on a flange 12' of the stem 2', whereas in the variant shown on the right the end of the tubular sleeve remote from the head is joined to the stem 2" by means of a circular weld 12. The end of the tubular sleeve 11 facing the valve head 3 in both cases forms the stem-side flange 7'. The unilateral fixing 12, 12' of the sleeve 11 to the valve stem tube remote from the head means that the axially opposing flange 7' is free to move axially in relation to the valve stem tube within the limits of the elasticity of the material, this elastically defined displacement increasing in direct proportion to the length L of the sleeve.

Furthermore, in an embodiment shown in FIG. 5 the bearing surface 5' fitted in the area of the center opening 4' of the valve head 3 and corresponding to the stem-side flange 7' is axially shifted inside the center opening 4'. This results in a grip 1 significantly smaller than the axial height of the valve head 3, or the length L of the sleeve 11.

After tightly pushing the valve head 3 on to the end of the valve stem 2', 2", the heading 8' is formed into the enlargement 6 and the positively interlocking connection is made between the valve stem and the valve head. Where the valve head is formed from a material having a significantly lower coefficient of thermal expansion than steel it is important in the process of joining head and stem that the positively interlocking connection be under the greatest possible axial pre-tensioning at the room temperature of the valve. Only by virtue of a high axial pre-tensioning of the joint and the special design of the elastically displaceable flange 7' with pre-tensioning force reserve margin is it possible to ensure that the valve head 3, composed of ceramic, for example, will still remain firmly clamped to the valve stem with a certain residual pre-tensioning even at the operating temperature of the valve. The greater the ratio of sleeve length L to grip 1, the greater the pre-tensioning reserve margin of the connection. It may therefore be quite expedient to extend the sleeve 11 over virtually the entire length of the valve stem.

In order to be able to guarantee the highest possible axial pre-tensioning of the positively interlocking connection, the sleeve 11 and the valve head should be as cold as possible whilst producing the heading 8' and as hot as possible whilst producing that part of the valve stem tube extending inside the sleeve. A temperature equalization between the parts should be allowed to come about only once the heading 8' has cooled and can no longer be plastically deformed. The delayed equalization of such an enforced temperature difference causes an axial pre-tensioning to build up. Considering the high operating temperatures of exhaust valves, in particular, the aim should be for the highest possible degree of pre-tensioning at room temperature, since this pre-tensioning diminishes as the operating temperature increases. Ideally the joint pre-tensioning at room temperature should be close to the limit of elasticity of the steel material.

What is claimed is:

1. A multi-piece valve for reciprocating piston engines, comprising a valve stem having a head-side end and a flange; and a valve head including a combustion chamber-side, a center through-opening extending to the combustion chamber-side, and an annular bearing surface, wherein the center through-opening has a larger section at the combustion chamber side, wherein the valve stem extends into the center through-opening of the valve head, wherein the flange of the valve stem bears against the annular bearing surface of the valve head to limit the insertion depth of the valve stem into the center through-opening of the valve head, wherein the head-side end of the valve stem is expanded in the larger section of the center through-opening, wherein the larger section of the center through-opening and the expanded head-side end of the valve stem deviate from a rotationally symmetrical shape to form a positive torsional interlock connection between the valve stem and the valve head.

2. The valve as claimed in claim 1, wherein the valve stem has a hollow, gas tight interior and a head at the head-side end to close the hollow interior, and wherein the head of the valve stem is expanded in the larger section of the center through-opening.

3. The valve as claimed in claim 1, further comprising a tubular sleeve having an end remote from the valve head, wherein the flange of the valve stem is formed by the tubular sleeve, which is fixed at the end at a predefined axial position on the valve stem.

4. The valve as claimed in claim 3, wherein the annual bearing surface of the valve head is placed inside the center opening in such a way that this results in a grip smaller than the axial height of the valve head.

5. The valve as claimed in claim 1, wherein the valve head is composed of a lightweight material.

6. The valve as claimed in claim 5, wherein the valve head is composed of a ceramic.

7. The valve as claimed in claim 6, wherein the ceramic is silicon carbide (SiC).

8. The valve as claimed in claim 5, wherein the valve head is composed of a titanium-aluminum alloy.

9. The valve as claimed in claim 5, wherein the valve head is composed of an intermetallic phase.

10. The valve as claimed in claim 9, wherein the intermetallic phase is titanium aluminide.

11. The valve as claimed in claim 1, wherein a radial width of the flange and the annular bearing surface is less than, or equal to, approximately 25% of the diameter of the valve stem.

12. The valve as claimed in claim 11, wherein the radial width of the flange and the annular bearing surface is less than, or equal to, approximately 15 to 20% of the diameter of the valve stem.

* * * * *